United States Patent [19]

Jahn

[11] 4,129,914

[45] Dec. 19, 1978

[54] AUTOMATIC LOADING TRAY

[76] Inventor: Gerhard Jahn, Apartment 1907, 655 Broadview Ave., Toronto, Ontario, Canada

[21] Appl. No.: 748,928

[22] Filed: Dec. 9, 1976

[51] Int. Cl.[2] ..... B42C 15/00

[52] U.S. Cl. ..... 11/2; 29/281.4

[58] Field of Search ..... 11/2, 3, 1 R; 269/114, 269/229, 236, 113, 235; 29/281.4, 281.3; 100/229 R, 224

[56] References Cited

U.S. PATENT DOCUMENTS

| | | | |
|---|---|---|---|
| 513,453 | 1/1894 | Coles et al. | 11/2 |
| 880,033 | 2/1908 | Mugler | 11/2 |
| 1,464,389 | 8/1923 | Lancaster | 269/114 |
| 2,021,214 | 11/1935 | Wilson | 11/2 |
| 2,456,613 | 12/1948 | Archambault | 269/229 |

*Primary Examiner*—Donald R. Schran

[57] ABSTRACT

An improved automatic loading tray comprising a frame having lateral side rails and a pair of longitudinal cross-bar arrangements spaced from each other and secured to the lateral side rails for reciprocal movement therealong, each cross-bar arrangement including two laterally spaced substantially parallel bars, an inner and outer bar, said inner bar nearer said other cross-bar arrangement than said outer bar, and means to limit maximum separation between said two spaced bars, rotatable spacer means for positioning between said spaced bars, said rotatable means being of substantially uniform non-circular or non-square cross-section looking downwardly thereon for causing the bars to abut said means to limit their maximum separation when said rotatable means is positioned between said bars in a first position and for causing said bar to loosely seat between said means to limit maximum separation when said rotatable means is in a second position, and means to rotate said rotatable spacer means.

22 Claims, 9 Drawing Figures

72
74
76
65
48
60
66
58
96
64
100
54
94
53
92
52
62
68
99
98
84
88
82
80
86
90

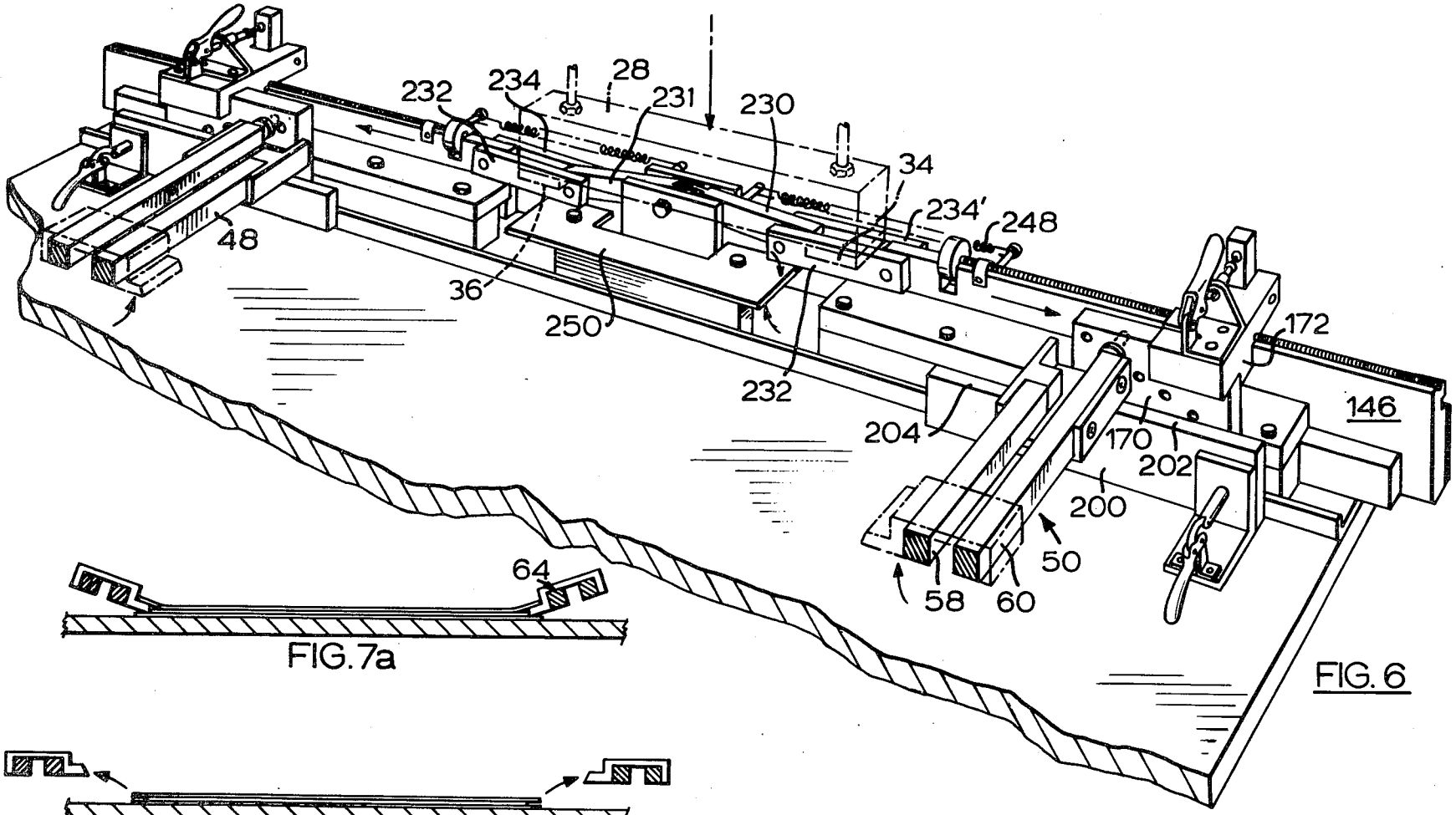
FIG. 6
FIG. 7a
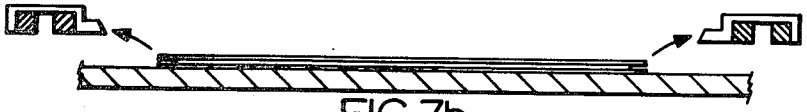
FIG. 7b

AUTOMATIC LOADING TRAY

FIELD OF THE INVENTION

This invention relates to what is colloquially called in the loose-leaf binder and presentation folder manufacture art, as an Automatic Loading Tray

BACKGROUND OF THE INVENTION

Loose-leaf binders and presentation folders include front and back covers and a spine therebetween, generally manufactured from two sheets of polymeric material, sandwiching a plurality of cardboard panels of predetermined shape and size, disposed in predetermined relation to one another between the sheets to form the covers and spine. The various components are then heat sealed together to form the finished binder.

The heat sealing operation is usually performed using a heat sealing apparatus having a base and a sealing head, the sealing head being reciprocal from a position spaced from the base to a position adjacent to it, and has on the underside of the sealing head, cutting and sealing die in specific relation to engage the component elements to comprise the loose-leaf binder or presentation folder, and cut and seal such components according to the design of the die, to provide the desired end product.

In order to maximize the output of the heat sealing apparatus the areas on either side have been designed to permit the setting up of the components relative to one another for feeding to a position below the head, where they are heat sealed and then returned to their initial position where the finished binder is removed and the next components to comprise the finished product are aligned relative to one another to permit the above operation to be carried out efficiently.

The areas on either side of the apparatus each usually include a table mounted for horizontal reciprocation on rails extending between the areas, past the sealer, for alternate reciprocation of the tables from the initial position whereat the materials are set up, to the second position below the sealer head and back again to the initial position, once the heat sealing operation has been completed. Therefore, when one table is beneath the sealer, the other table is at its initial position, whereat the components are being set up. When the first table is reciprocated back to its initial position, the second sealer in turn, is reciprocated to a position below the sealer and so on.

As is evident from the above discussion, it is necessary to align the component elements relative to one another and to the table so that they are appropriately positioned for accurate action by the cutting and sealing rules of the die carried on the underside of the sealer when the sealing head is lowered to engage the cutting and sealing rules of the die with the components. If the table is not reciprocated precisely to the exact position below the sealer each time, or the component elements are jostled in any way, the binder or presentation folder as the case may be, manufactured according to the above process, may be improperly manufactured and therefore unmarketable. Therefore, to assist in the alignment of the component elements, one to the other, to permit continuous duplication of the binder time after time, the industry has proposed the use of what is called, an Automatic Loading Tray, positioned on the table which orients the component elements, one to the other, and to the table so that if the table is returned to the same position below the heat sealer at all times, then so long as the materials were not jostled when moved from the first position whereat they were aligned relative to one another, to the second position where they were heat sealed to which the invention disclosed in my application Ser. No. 850,051 relates, not forming part of this invention, then a marketable binder was consistently produced. However, prior proposed Automatic Loading Trays were deficient particularly in their ability to make quick adjustments to vary the configuration, including minor adjustments to correct for improper alignment of the components in the Automatic Loading Tray, and the cost of replacing component parts.

With respect to minor adjustments, they could not be made rapidly, and replacing parts required substantial costs, due to the nature of the structure of the component.

It is therefore, an object of this invention to provide an improved Automatic Loading Tray, which overcomes the above deficiencies in the prior art, providing for ease of assembly and adjustment, ease of repair or replacement of component parts, all at minimal cost.

Further and other features and objects of the invention will be understood by those skilled in the art, from the following summary of the invention and detailed description of a preferred embodiment thereof.

SUMMARY OF THE INVENTION

According to one aspect of the invention, rotatable spacer means useful in an improved Automatic Loading Tray and an improved Automatic Loading Tray are provided, the Automatic Loading Tray comprising a frame, having lateral side rails and a pair of longitudinal cross-bar arrangements spaced from each other and secured to the lateral side rails for reciprocal movement therealong, each cross-bar arrangement including inner and outer spaced, substantially parallel bars, the inner bar being closer to the opposite cross-bar arrangement than the outer bar, and rotatable spacer means between the bars to space the bars from one another, and means co-acting with each bar to limit maximum separation between the bars, said rotatable spacer means being of substantially uniform non-circular or non-square cross-section looking downwardly thereon for causing the inner and outer bars to abut said means, limiting maximum separation of the bars when said rotatable means is in a first position and cause the bars to loosely seat between said means limiting maximum separation when said rotatable spacer means is in the second position, and having means to reciprocate said rotatable means from said first position to said second position.

According to another aspect of the invention, said vertically spaced flanges on either end of said rotatable means for engagement with said bars of the cross-bar arrangement may be provided to maintain said rotatable means between said bars.

According to another aspect of the invention, said rotatable spacer means separating said spaced bars may be of rectangular or elliptical cross-section.

Preferably, when said means is rectangular in cross-section, the corners engaging the cross-bars of the rotatable spacer means when the rotatable means is rotated from its initial position to the second position are rounded, to act as a bearing surface.

According to another aspect of the invention, said means limiting the maximum separation of the bars may include a plurality of flanges or fingers adjacent said inner bar on the side of the inner bar remote said outer bar and projecting away from said outer bar towards the other cross-bar arrangement for precisely positioning the component elements used for the manufacturing of the binder relative to one another.

According to another aspect of the invention, each cross-bar arrangement may be mounted for reciprocal movement along said side rails, such that at least one end of the outer bar is seated on a ledge at all times secured to said lateral side rails and at least one end of said inner bar is reciprocal from a position off said ledge to a position on said ledge, whereby said fingers on said means limiting maximum separation of the bars are reciprocated from a position in contact with the elements used to manufacture the binder when the component elements are positioned in the Automatic Loading Tray, to a position out of contact with them and means are provided to reciprocate the bars.

According to another aspect of the invention, an improved Automatic Loading Tray is provided, having a frame comprising a pair of spaced lateral side rails, a pair of longitudinal cross-bars, secured for lateral reciprocation along the length of the side rails, and means secured to each of the cross-bars and to at least one of the lateral side rails to permit lateral reciprocation of the cross-bars relative to the side rails, vertical adjustability of each cross-bar relative to the side rails, and lateral adjustability of the cross-bars relative to said means secured to said cross-bars.

According to another aspect of the invention, said means is secured to said at least one lateral side rail by a clamp secured to said means for no relative movement to said means, but which clamp is laterally adjustable along the length of the side rail to permit adjustment of the position of said means along the length of the side rail.

According to another aspect of the invention, said means comprises duplicate plates, one for each cross-bar, secured for relative movement to said at least one side rail, by the clamp which is adjustable along the length of the side rail, each plate having apertures therein at various heights along its length to hold a longitudinally extending pin from each cross-bar.

According to another aspect of the invention, the at least one side rail supports a threaded rod thereon, and each clamp is secured for movement along the length of the threaded rod.

BRIEF DESCRIPTION OF THE DRAWINGS

The invention will now be illustrated having regard to the following drawings disclosing preferred embodiments of the invention, in which:

FIG. 6 illustrates the structure of FIG. 4 in a different operating position;

FIG. 7*a* and 7*b* illustrate diagrammatically the positioning of two components in their operative positions shown in FIG. 4 and 6 respectively, when component elements are positioned in the Automatic Loading Tray.

DETAILED DESCRIPTION OF A PREFERRED EMBODIMENT OF THE INVENTION

Figure 1:
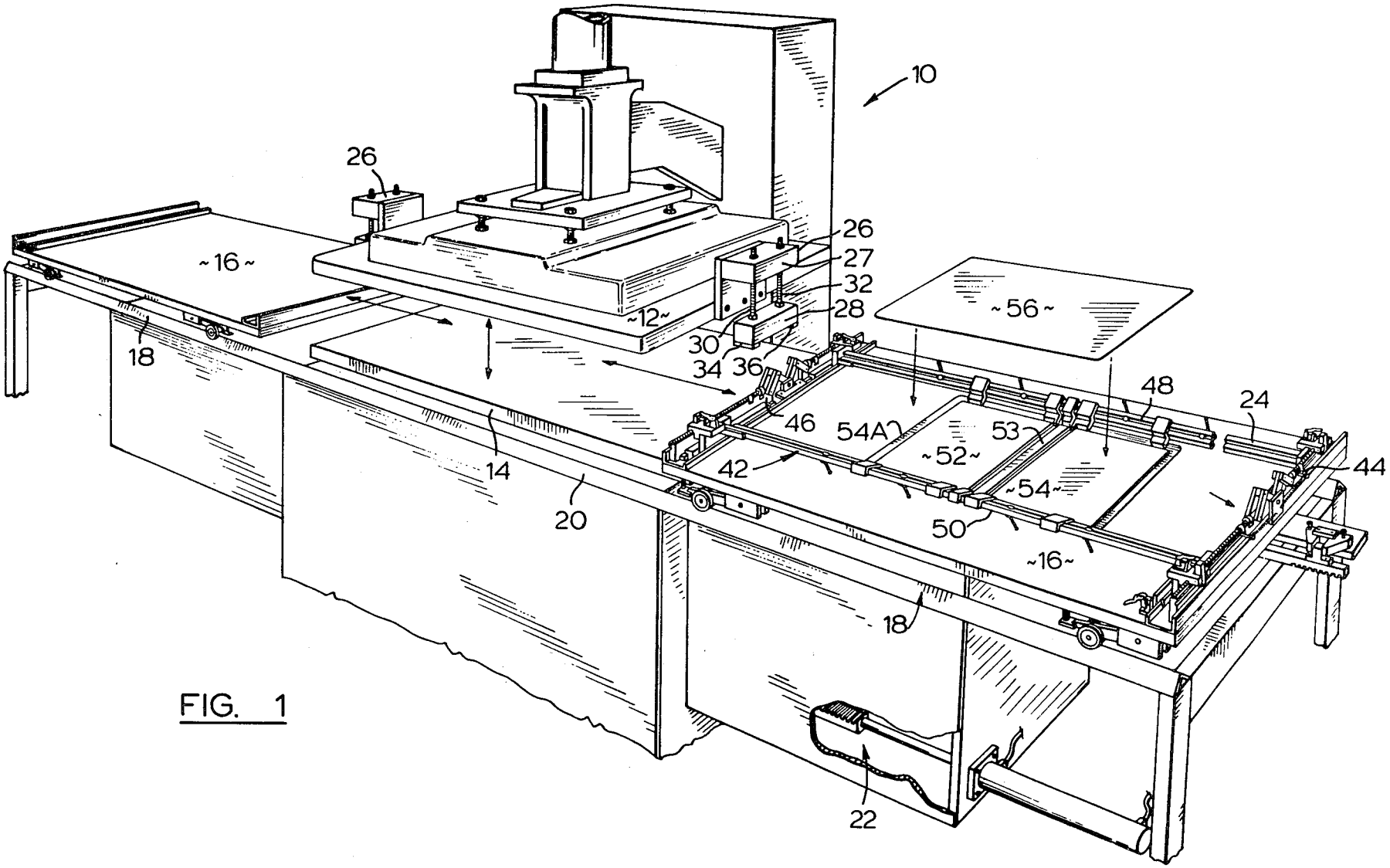
FIG. 1 is a perspective view of an apparatus embodying the invention.

With reference to FIG. 1, there is shown a conventional heat sealing apparatus 10, having reciprocating sealer head 12, reciprocal from a position adjacent its base 14 to a position vertically spaced from it. On either side of apparatus 10, are disposed horizontally reciprocable tables 16, reciprocal on rails 18, only one of which is shown in full detail, as 20, from a position at one side of apparatus 10, to a position below sealer head 12, by drive means 22 (not shown) described in detail in my co-pending application serial number Situated on each of tables 16, are Automatic Loading Trays 24, only one of which is shown in FIG. 1. However, it is to be understood that the components relating to the one Automatic Loading Tray, to the right of heat sealing apparatus 10 are equally applicable to the other Automatic Loading Tray.

As shown in FIG. 1, heat sealing appartus 10 has on either side of head 12, depressor 26 having head 28, vertically spaced from support 27 by posts 30 and 32, secured in head 28. Disposed on the undersurface of head 28 and at opposite ends thereof, are block elements 34 and 36.

Automatic Loading Tray 24 comprises a frame generally indicated at 42, comprising side rail formation 44 on one side and side rail formation 46 on the other side. Extending longitudinally therebetween are cross-bar arrangements 48 and 50, spaced laterally from one another and so oriented in FIG. 1 to precisely position elements 52,53, 54 and 54A relative to one another and permit the positioning of element 56 onto elements 52 and 54 in predetermined relationship for engagement by the die (not shown) on the undersurface of sealer head 12 when table 16 and thus Automatic Loading Tray 24 are positioned thereunder.

Figures 2, 3A, 3B:
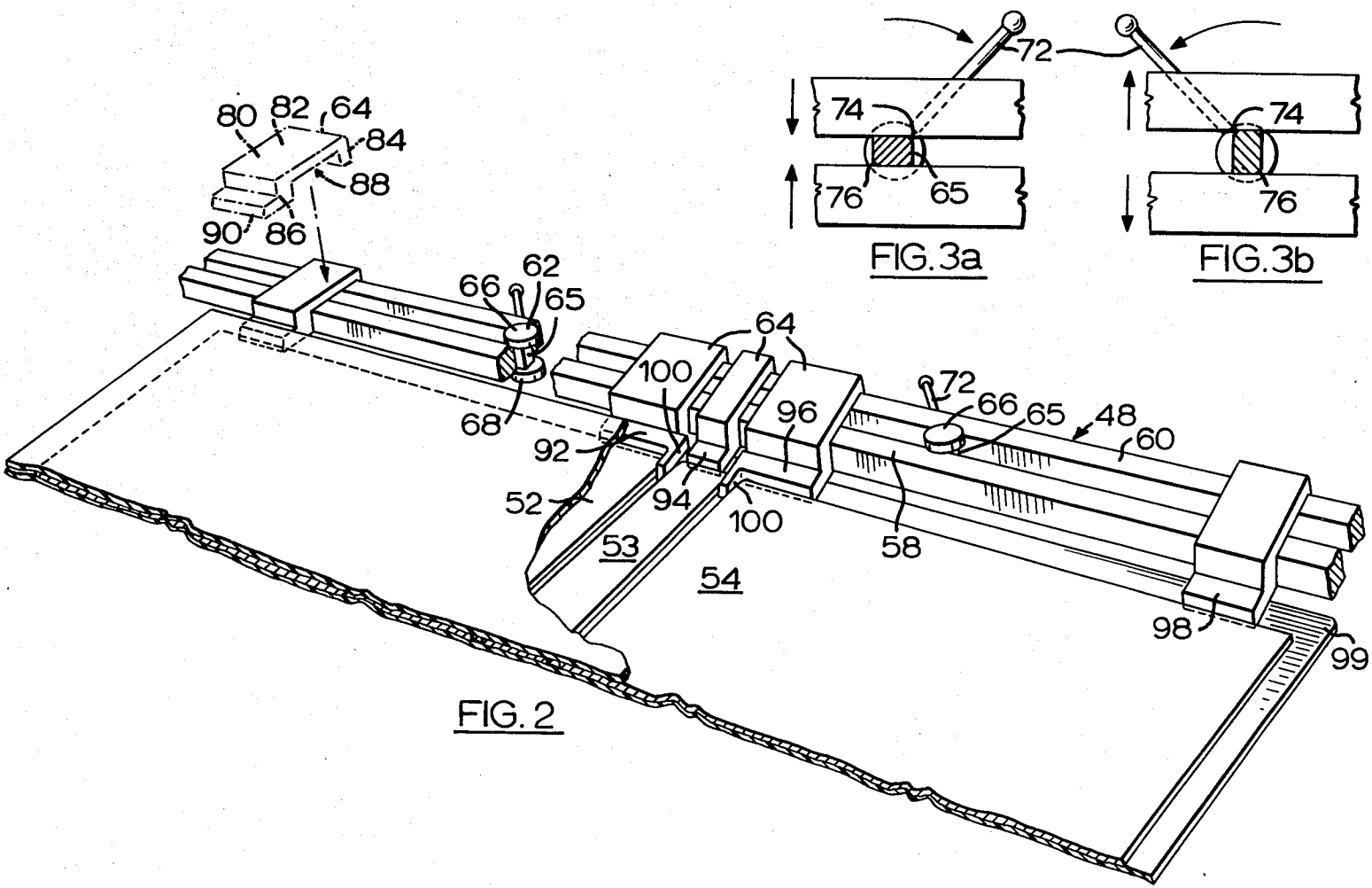
FIG. 2 is a close-up partly in cross-section of a portion of FIG. 1.
FIGS. 3*a* and 3*b* are diagrammatic illustrations of the operation of part of the structure shown in FIG. 2.

With reference to FIG. 2, cross-bar arrangement 48 is shown comprising inner bar 58 and outer bar 60 each substantially square in cross-section, spaced from one another by spacer blocks 62, and positioned between brackets 64 to limit their maximum separation. Spacer blocks 62 each include a central core 65, of substantially rectangular cross-section looking downwardly thereon (seen best in FIG. 3*a* and 3*b*), sandwiched between upper and lower flanges 66 and 68 respectively, to ride on the upper and lower surfaces of bars 58 and 60. Pivot arm 72 protrudes from the lower flange 68 (seen best in FIGS. 3*a* and 3*b*). Core 65 has each of diagonally opposed corners 74 and 76 rounded to act as bearing surfaces against bars 58 and 60 when pivot arm 72 rotates spacer block 62 from its position shown in FIG. 3*a* to the position shown in FIG. 3*b*.

Seated on longitudinal bars 58 and 60 are a plurality of brackets 64, one of which is shown exploded from the apparatus in FIG. 2 as bracket 80 comprising top plate 82 and end walls 84 and 86 extending downwardly therefrom, defining downwardly directed channel 88. Attached to wall 86 at the end opposed plate 82 is flange 90, directed away from both wall 86 and wall 84, known in the art as a "finger". The shape of each finger may vary depending upon the use to which each will be put. See for example, flanges 92, 94, 96 and 98 overlying vinyl sheet 99 shown in FIG. 2. Fingers 92 and 96 are mirror images of one another and include an additional projection 100 at one end of the finger, used for spacing component cardboard element 52, 53 and 54.

Figure 4:
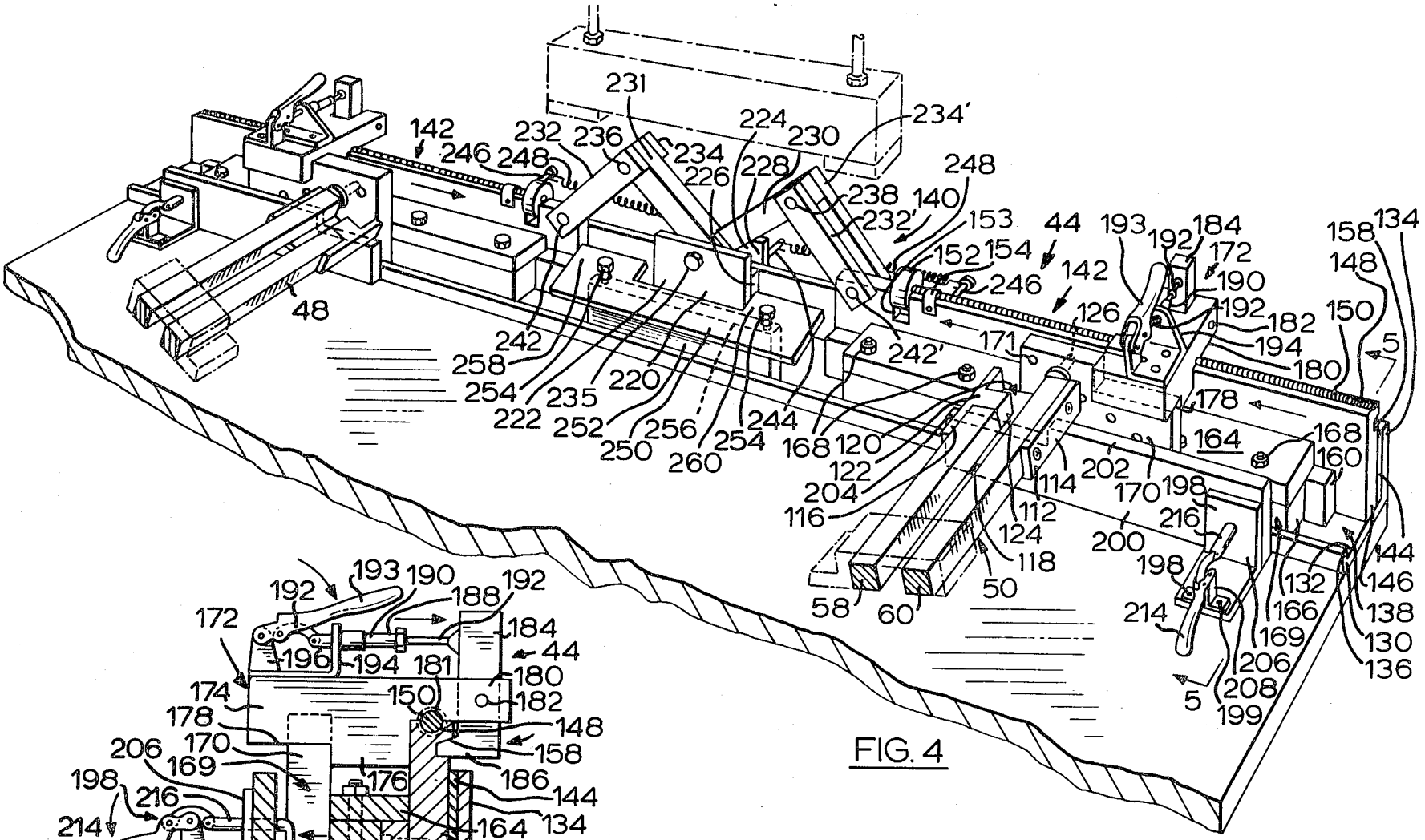
FIG. 4 is a close-up of part of the apparatus shown in FIG. 1, by the arrow 4.

With reference to FIG. 4, it will be seen that the ends of bars 58 and 60 are joined by modified U-bracket 112 having side walls 114, 116 and base 118, defining upwardly directed channel 120 in which the bars seat. Bar 60 is secured to side wall 114 by screws threaded thereinto and bar 58 is secured adjacent wall 116 by overhead wall 122 extending inwardly into channel 120, and, by downwardly extending wall 124 extending downwardly from wall 122 to define a sleeve into which the end of bar 58 is telescoped. A like bracket is provided at each of the ends of the cross-bar arrangements, 48 and 50.

Each cross-bar arangement is secured to side rails 44 and 46, by pin 126 secured into eah end of bar 60 in the manner hereinafter described.

Figure 5:
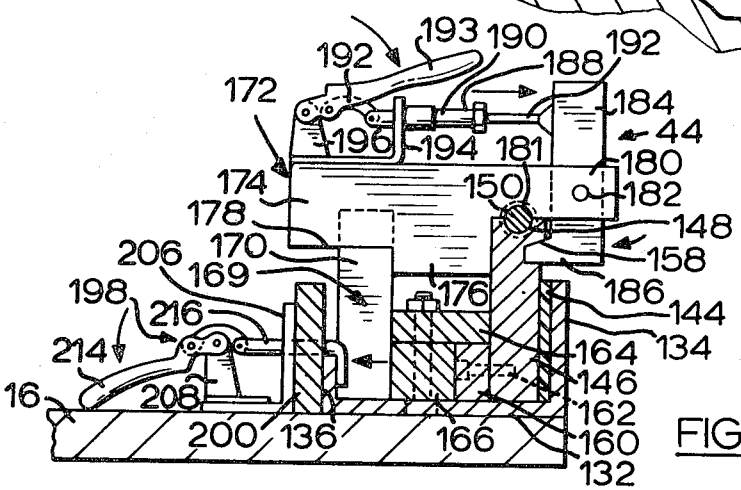
FIG. 5 is a cross-section taken on the line 5—5 of FIG. 4, looking in the direction of the arrows.

With reference to FIGS. 4 and 5, there is shown a side rail 44 which is substantially the same as side rail 46 except for one modification hereinafter described. U-Bracket 130, secured to table 16 and running the full width of the table, has base 132, outer side wall 134 and inner side wall 136 of less height than outer side wall 134 to define therebetween upwardly directed channel 138. Side rail 44 sits in bracket 130 and includes spring mechanism 140, flanked by identical side rail structures 142. Side rail structures 142 each comprise bearing strip 144, secured to adjacent block 146 and abutting wall 134 to provide a buffer between block 146 and wall 134.

Block 146 has semi-circular upper recess 148 running down the centre of the top surface of block 146 in which recess threaded rod 150 is secured by bracket 154 secured to block 146. Head 152 in channel 153 of block 146 secured to the end of rod 150 is provided to permit rotation of pin 150 in recess 148.

On the side block 146 adjacent wall 134 adjacent its upper end, is channel 158, cut into, and running along the length of, block 146.

Next to block 146 is block 160, shorter in length than block 146, and secured by pin 162 into block 146 and disposed in a channel formed below upper member 164 and between block 146 and side block 166 secured to bracket 130 by pins 168. Between block 166 and wall 136 is small stepped block or index plate 170 of lesser length than the length of the channel 160 formed between block 166, bottom 132 of U-bracket 130, and wall 136 for riding lengthwise in the channel portion 169. Block 170 has a plurality of holes 171 therein of a size to accommodate pin 126 projecting from bar 60. Block or plate 170 is also stepped to provide a seat for clamp 172.

Clamp 172 includes body 174, which has projection 176 of the same width as block 164 extending downwardly into the space between block 146 and block 170, between base portions 178 and 180, base portion 178 to seat on the stepped portion of block 170 and base portion 180 having a threaded semi-circular groove 181 running its length to accommodate threaded rod 150. Secured to portion 180 by pivot pin 182 in arm 184 having projection 186 extending inwardly for locking projection 186 in notch 158 when groove 181 is positioned over threaded rod 150 for locking block 170 against movement. Arm 184 and thus projection 186 is pivoted by adjustable arm 188, having telescoping portions 190 and 192 for threaded adjustment, and, connected to pin 192 and arm 193 through L-bracket 194 secured to block 174. Arm 193 is pivotally secured to support 196. Therefore, when upper arm 193 is rotated in a clockwise direction shown in FIG. 5, pin 192 is pushed downwardly pushing arm 188 inwardly to abut arm 184 and cause it to pivot about pin 182 and lock projection 186 securely in channel 158, thereby securing block 170, against movement in channel 169. With reference to both FIGS. 4 and 6, it is apparent that in light of the above construction, strip 144, block 146, blocks 160 and 170 and clamp 172 all move as a unit when projection 186 is locked into channel 158 of block 146, on base 132 of bracket 130.

Block 200 is secured to wall 136 on the side of wall 136 remote wall 134 by clamp 198 and has upper step 202 and a lower step 204 and aperture (not shown) adjacent the end of the upper step 202 remote the lower step 204. Clamp 198 has a mounting L-plate 206 on which is mounted support 208 by pins 199, and has pivot arm 214 secured to hook arm 216 projecting through the vertical portion of mounting plate 198 and through the aperture in block 200 (not shown) to hook over wall 136 and abut the surface of wall 136 remote block 200 to lock block 200 against wall 136. To loosen clamp 198, arm 214 is rotated in a clockwise direction to move block 216 away from wall 136, releasing the pressure permitting block 200 to be lifted and moved.

Clamps 172 and 198 are type #601 Clamps and may be purchased from De-Sta-Co. Division of Dover Corportion, 350 Midland Ave., Detroit, Mich., U.S.A.

Central spring mechanism 140 includes a central mounting portion 220, comprising upwardly extending walls 222, and 224 separated by block 226 forming channel 228 between the upper parts of panels 222 and 224. Block 226 extends through wall 134 of bracket 130 so that walls 222, and 224 are on either side of wall 134. Link arms 230 and 231 are secured in side by side pivotal relation on pin 235 extending through panels 222 and 224. Sandwiching the other end of each of the arms 230 and 231 are a pair of link arms 232 and 234, and $232^1$ and $234^1$, pivotally secured about pins 236 and 238 respectively, which are in turn pivotally secured to block 146 by pins 242 and $242^1$ respectively. Like pins 244 and 246, extend outwardly from, either end of wall 224, only one of which is shown at 224, and, the end of block 146 adjacent head 152 in a direction away from wall 134, and secure the ends of springs 248 thereto. Lever 250 is mounted on block 252, secured in U-bracket 130. disposed between wall 220 and wall 136, by pins 254 which permit lever 250 to pivot vertically about the edge 256 of block 252 remote wall 220. Lever 250 has inwardly directed end flanges 258 and 260 positioned directly below arms 232 and $232^1$ so that when the arms are in depressed position as shown in FIG. 6, they seat on flange portions 258 and 260.

As indicated previously, side rails 44 and 46 are substantially the same except for one modification. The modification is that side rail 46 does not include a block 200 having steps 202 and 204 and therefore, does not require clamp 198 for securement thereof since only one end of the cross-bar arrangement need be controlled for the other end to act in a similar manner.

Assembly of the Automatic Loading Tray is simple, each of side rails 44 and 46 are secured within U-bracket 130 in the manner previously described, securing bars 58 and 60 spaced by spacer blocks 62 into bracket 112 and pins 126 into each of blocks or plates 170 by releasing clamp 172 and removing block 170 and clamp 172, positioning each pin 126 into one of the holes 171, as desired, and repositioning the block and clamp thereby maintaining pins 126 within each block 170, until block 170 is again removed, and thus seating bar 60 on step 202. Brackets 64 may then be inserted over bars 58 and 60.

It should be noted that no hole in block 170 is such as to position bar 60 to seat on ledge 204 when pin 126 is inserted therein. Bar 60 always remains on lodge 202. The fingers may then each be adjusted or positioned on the bar when spacer block 62 is in a position as in FIG. 3*a* and then may be locked in position when the spacer block is moved to a position as in FIG. 3*b*.

If it is desired to increase or decrease the distance between cross-bar arrangements 48 and 50, head 152 is rotated, thereby rotating threaded pin 150 which in turn moves clamp 172 and thus block 172 to which each cross-bar arrangement is secured, thereby providing a micrometer or fine adjustment for positioning the cross-bar arrangement 48 and 50.

The operation of the Automatic Loading Tray is best seen in FIGS. 2, 4 and 6. The Automatic Loading Tray is oriented in the desired manner-spacing the fingers on the cross-bar arrangement and adjusting the distance between cross-bar arrangements 48 and 50. The component elements to comprise the finished binder are appropriately positioned (see FIGS. 2, 4 and 7*a*). The table and thus the Automatic Loading Tray 24 is reciprocated to a position below the sealer head 12. As the head is depressed, the block elements 36 and 34 engage the arms 232 and 234 and $232^1$ and $234^1$, and the head engages arms 230 and 231 and forces them to a position below horizontal (see FIG. 6) forcing block 146, clamp 172, block 170 and thus cross-bar arrangements 48 and 50, to move outwardly away from one another, thereby causing bar 58 to climb from step 204 to top step 202, thereby positioning brackets 64 and thus fingers 92, 94, 96 and 98 out of contact with the component elements to comprise the binder shown in FIG. 7, and permit the die of the heat sealer to act on the elements to form the binder. Then, the table is reciprocated, the binder is removed and the component elements to comprise the next binder are positioned on the table.

At an appropriate time, lever 250 is depressed, raising arms 230, 231, 232, 234, $232^1$, and $234^1$ assisted by springs 248 to their original position, thereby bringing brackets 64 and thus flanges 92, 94, 96 and 98 into position for positioning the component elements of the next binder, shown in FIG. 7*a*.

If there is any necessary adjustment of the fingers, spacer blocks 62 are rotated by pivot arms 72 from the position shown in FIG. 3*b* to the position shown in FIG. 3*a* to cause block 70 to rotate on bearing curved surfaces 74 and 76, to a position whereby bars 58 and 60 are not locked against for example, walls 84 and 86 or bracket 80 to permit the sliding of brackets 64 along bars 58 and 60 for reciprocation. Once the brackets 64 are repositioned, arm 72 is rotated in a counterclockwise direction from that shown in FIG. 3*a* to that shown in FIG. 3*b* to lock the bars 58 and 60 into intimate contact with the inner surface of side walls 84 and 86.

As many changes could be made in the invention without departing from the scope thereof, it is intended that all matter contained herein be interpreted in an illustrative sense, and not in a limiting manner.

The embodiments of the invention in which an exclusive property or privilege is claimed are:

1. Suitable for use in an Automatic Loading Tray, comprising a frame having lateral side rails and a pair of longitudinal cross-bar arrangements spaced from each other and secured to the lateral side rails for reciprocal movement therealong, each cross-bar arrangement including two laterally spaced substantially parallel bars, and inner and outer bar, said inner bar nearer said other cross-bar arrangement than said outer bar, and means to limit maximum separation between said two spaced bars, rotatable spacer means for positioning between said spaced bars, said rotatable means being of substantially uniform non-cicular or non-square cross-section, looking downwardly thereon for causing the bars to abut said means to limit their maximum separation when said rotatable means is positioned between said bars in a first position and for causing said bar to loosely seat between said means to limit maximum separtion when said rotatable means is in a second position, and means to rotate said rotatable spacer means.

2. Rotatable spacer means of claim 1 further including vertically spaced flanges sandwiching said rotatable means for engagement with the bars of the cross-bar arrangement to maintain said rotatable means between said bars.

3. Rotatable spacer means of claim 2, wherein its cross-section looking downwardly is rectangular.

4. The rotatable spacer means of claim 3, wherein the corners of said means engaging said bars when said rotatable means is positioned between said bars, and said rotatable means is rotated from said first position to said second position, are rounded.

5. The rotatable spacer means of claim 2, wherein its cross-section looking downwardly is elliptical.

6. Rotatable means of claim 2 wherein said means for rotating said rotatable means comprises an arm extending from one of said flanges.

7. An Automatic Loading Tray, comprising a frame having lateral side rails and a pair of longitudinal cross-bar arrangements spaced from each other and secured to the lateral side rails for reciprocal movement therealong, each cross-bar arrangement including two laterally spaced substantially parallel bars, an inner and outer bar, said inner bar nearer said other cross-bar arrangement than said outer bar, and means to limit maximum separation between said two spaced bars, rotatable spacer means for positioning between said spaced bars, said rotatable spacer means being of substantially uniform non-circular or non-square cross-section looking downwardly thereon for causing the bars to abut said means to limit their maximum separation when said rotatable spacer means is positioned between said bars in a first position and for causing said bar to loosely seat between said means to limit maximum separation when said rotatable spacer means is in a second position, and means to rotate said rotatable spacer means.

8. The Automatic Loading Tray of claim 7, wherein said rotatable spacer means further includes vertically spaced flanges sandwiching said rotatable means for engagement with the bars of the cross-bar arrangement to maintain said rotatable means between said bars.

9. The Automatic Loading Tray of claim 8, wherein the cross-section of said rotatable spacer means looking downwardly is rectangular.

10. The Automatic Loading Tray of claim 9, wherein the corner of said rotatable spacer means engaging said bars when said rotatable spacer means is rotated from said first position, is rounded.

11. The Automatic Loading Tray of claim 10, wherein the cross-section of said rotatable spacer means looking downwardly is elliptical.

12. The Automatic Loading Tray of claim 8, wherein said means for rotating said rotatable spacer means comprises an arm extending from one of said flanges.

13. The Automatic Loading Tray of claim 7, wherein said means limiting the maximum separation of the bars includes plurality of flanges disposed on said means adjacent said inner bar projecting away from said outer bar, for precisely positioning the component elements used for manufacturing the binder relative to one another.

14. The Automatic Loading Tray of claim 13, wherein each cross-bar arrangement is mounted for reciprocal movement along said side rails such that at least one end of the outer bar is seated on a ledge at all times and at least one end of said inner bar is reciprocable from a position off said ledge to a position out of contact with them, and means are provided to reciprocate said bars.

15. The Automatic Loading Tray of claim 7, further including means secured to each of the cross-bar arrangements and to at least one of the side rails to permit lateral reciprocation of the cross-bar arrangement relative to the side rails, vertical adjustability of each cross-bar arrangement relative to the side rails and lateral adjustability of the cross-bar arrangements relative to said means secured to said cross-bars.

16. The Automatic Loading Tray of claim 15, wherein said means is secured to said at least one lateral side rail by a clamp secured to said means for no relative movement to said means, but which clamp is laterally adjustable relative along the length of the side rail to permit adjustment of the position of said means along the length of the side rail.

17. The Automatic Loading Tray of claim 16 wherein said means comprises duplicate plates, one for each cross-bar arrangement, secured for relative movement to the at least one side rail by the clamp, each plate having apertures therein at various heights along its length to hold a longitudinally extending pin from each cross-bar arrangement.

18. The Automatic Loading Tray of claim 17, the at least one side rail supports a threaded rod thereon and each clamp is secured for movement along the length of the threaded rod.

19. An improved Automatic Loading Tray, having a frame comprising a pair of spaced lateral side rails, a pair of longitudinal cross-bars, secured for lateral reciprocation along the length of the side rails, and means secured to each of the cross-bars and to at least one of the lateral side rails to permit lateral reciprocation of the cross-bars relative to the side rails, vertical adjustability of each cross-bar relative to the side rails, and lateral adjustability of the cross-bars relative to said means secured to said cross-bars.

20. The Automatic Loading Tray of claim 19, wherein said means is secured to said at least one lateral side rail by a clamp secured to said means for no relative movement to said means, but which clamp is laterally adjustable along the length of the side rail to permit adjustment of the position of said means along the length of the side rail.

21. The Automatic Loading Tray of claim 20, wherein said means comprises duplicate plates, one for each cross-bar, secured for relative movement to said at least one side rail, by the clamp which is adjustable along the length of the side rail, each plate having apertures therein at various heights along its length to hold a longitudinally extending pin from each cross-bar.

22. The Automatic Loading Tray of claim 21, wherein the at least one side rail supports a threaded rod thereon, and each clamp is secured for movement along the length of the threaded rod.

* * * * *